United States Patent [19]

Quimby, Sr. et al.

[11] Patent Number: 4,993,612

[45] Date of Patent: Feb. 19, 1991

[54] PORTABLE BACK CARRIER FOR CARRYING A PERSON

[76] Inventors: Robert J. Quimby, Sr.; Michael S. Quimby, both of 1351 Todd Farm, Apt. 202, Elgin, Ill. 60123

[21] Appl. No.: 420,924

[22] Filed: Oct. 13, 1989

[51] Int. Cl.[5] ..... A61G 1/00

[52] U.S. Cl. ..... 224/160; 224/159

[58] Field of Search ..... 224/158, 159, 160, 161, 224/153

[56] References Cited

U.S. PATENT DOCUMENTS 652,352 6/1900 Doell ..... 224/160

FOREIGN PATENT DOCUMENTS 167146 11/1950 Austria ..... 224/160
324389 3/1914 Fed. Rep. of Germany ..... 224/160
106331 8/1924 Switzerland ..... 224/160
907687 10/1962 United Kingdom ..... 224/160

*Primary Examiner*—Linda J. Sholl

*Attorney, Agent, or Firm*—Charles F. Lind

[57] ABSTRACT

The disclosed portable back carrier is formed of flexible generally nonextendable strap means, to have shoulder loops, link straps connected off of the shoulder loops, and foot loops connected off of the link straps. A strap is connected between the shoulder loops, to locate the loops on the carrying person and to fit around the carried person's upper body. A strap is connected off of the load links, just above the foot loops, to locate the loops on the carrying person and to fit around the carrying person's midsection. Release buckles and friction slides may be incorporated in the straps to allow the back carrier to be easily used by both the carrying person and the carried person, and to fit such persons of different sizes. Thus, the carrying person can fit the shoulder loops onto his/her shoulders with the link straps depending along his/her sides, and the carried person can fit his/her feet into the foot loops and be supported thereby by standing adjacent the back of the carrying person while facing in the same direction.

17 Claims, 1 Drawing Sheet

PORTABLE BACK CARRIER FOR CARRYING A PERSON

BACKGROUND OF THE INVENTION

Portable carriers for allowing one person to support and carry another person are common, and are particularly popular where the carrying person is larger than the carried person, such as a parent carrying a child. In these situations, the age of the carried person may vary widely: between an infant where substantial or even total support of the carried person is needed, and a person older than perhaps six months or a year who can already sit up and walk.

Generally, such portable carriers are connected to the shoulders of the carrying person and rest against his/her back; and the carried person faces in the same direction as the carrying person and is adjacent his/her back. For infants, the orientation of the portable carrier may be reversed, being in front of the carrying person and holding the carried person to face the carrying person.

When the carried person is a young child but yet capable of walking, the portable carrier may be used more as a backup when the endurance of the carried person may give out, such as on a hike or an outing involving considerable walking and/or standing. For this purpose, the portable carrier should ideally be compact and lightweight, to allow it to be easily stored and carried about by the carrying person until such time as it may actually be needed.

On the other hand, the normal endurance of the carrying person might quickly give out if the portable carrier distributes the weight of the carried person poorly; which becomes quite apparent when the carried person might be forty or fifty pounds.

Along these same lines however, while it may be an effort for a parent to carry a child as the child becomes older and heavier, this act could constitute quality play time. A child's desire for having a "horsey-back" ride on an adult's back is but one example.

SUMMARY OF THE INVENTION

One object of the present invention is to provide a portable lightweight compact portable carrier that can be used to carry a person, either out of necessary or as entertainment, for the benefit of the carried person.

Another object of the present invention is to provide a portable carrier that may be secured to the back of the carrying person in a manner that adequately distributes the weight of the carried person relative to the carrying person, whereby making the portable carrier particularly suited to carry a person who might otherwise exceed an expected weight of a carried person and/or for a duration that might exceed an expected endurance of the carrying person; the portable carrier yet being of a compact lightweight nature for easy storage on and carriage by the carrying person even when its not in use.

To achieve these and other objects, the present invention may provide a portable back carrier having flexible generally nonextendable strap means formed to define shoulder loops, link straps connected off of the shoulder loops, and foot loops connected off of the link straps, whereby a carrying person can fit the shoulder loops onto his/her shoulders with the link straps depending along his/her sides, and a carried person can fit his/her feet into the foot loops and be supported thereby by standing adjacent the back of the carrying person while facing in the same direction as the carrying person.

A loop connected between the shoulder loops may fit around the carried person near the waist, the loop having a release buckle therein to allow the carried person to get into or out of the carrier easily and also having length adjusting means therein to fit carried persons of different sizes.

A loop connected off of the load links is adapted to fit around the carrying person near the waist, the loop having a release buckle therein to allow the carrying person to get into or out of the carrier easily and also having length adjusting means therein to fit carrying persons of different sizes.

BRIEF DESCRIPTION OF THE DRAWINGS

Further objects, advantages and features of the present invention will appear from the following disclosure and description, including as a part thereof the accompanying drawings, where certain of the components may be broken away for clarity of disclosure and in which.

DETAILED DESCRIPTION OF AN ILLUSTRATED EMBODIMENT

Figure 1:
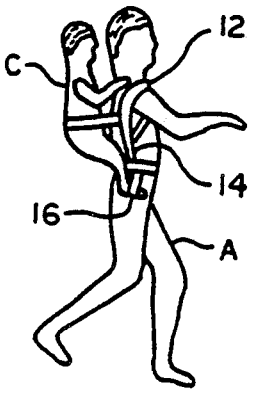
FIG. 1 is a right side elevational view of the subject portable carrier of this invention shown in use in carrying a child "C" on the back of an adult "A"

The carrier 10 to be disclosed is adapted to cooperate with the upper body of a carrying person "A" (see FIG. 1), generally at the shoulders, the chest and the waist or midsection of an adult carrying person; and to cooperate with the upper and lower body of the carried person "C", generally at the chest, the waist, the seat and the feet of a child carried person. The carrier 10 may be formed with flexible straps of generally nonextendable conventional construction, such as of woven nylon; and with side release buckle and slide adjustment devices conventionally used with such straps. Also, although the disclosure may make reference to several straps being connected together, the straps at times may in fact be common or unitary to one another and/or the connections may be made by conventional means, such as by being sewn, fused, stappled or the like.

Figure 2:
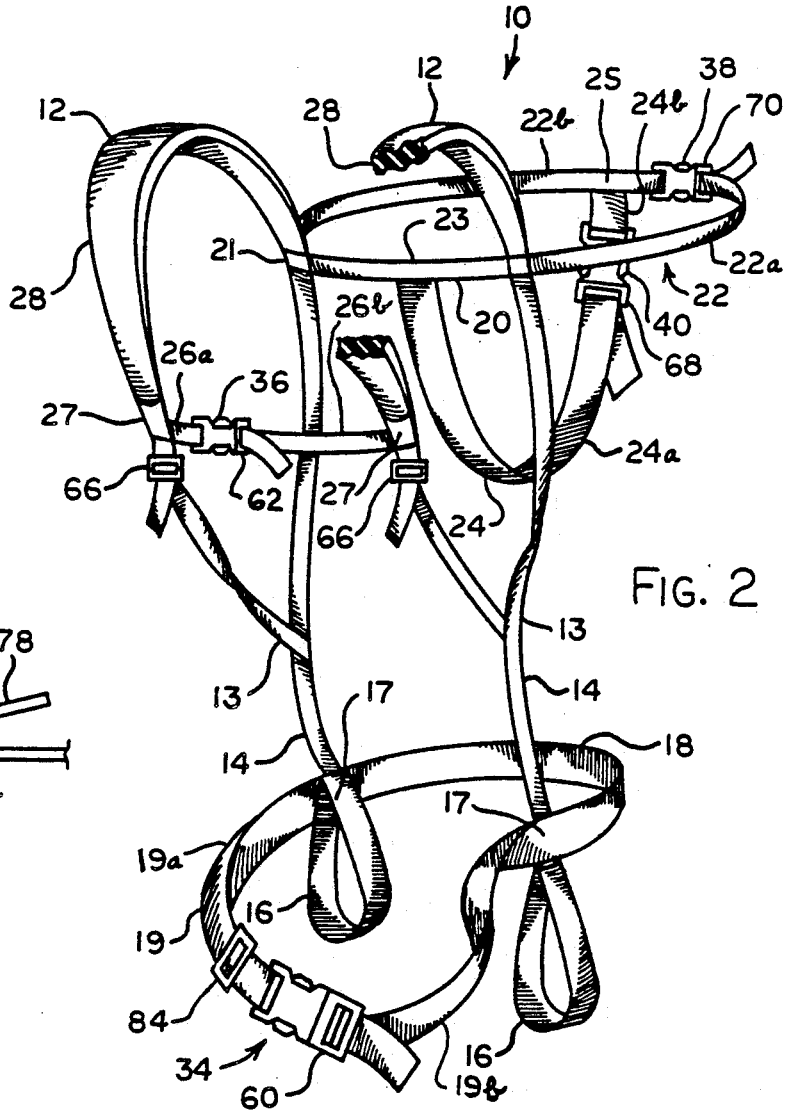
FIG. 2 is an enlarged frontal perspective view of the carrier, as seen generally from the left side, illustrated in an approximate operative orientation except without showing either the carried or carrying person.

Specifically as illustrated in FIG. 2, the carrier 10 may have a pair of straps defining loops 12 sized to fit over the arms and shoulders of the carrying person; a pair of link straps 14 connected at 13 off of the shoulder loops 12 to extend generally lengthwise along the body of the carrying person A; and a pair of loops 16 connected at 17 off of the link straps 14 and sized to loosely receive the feet of the carried person C.

A strap 18 is also connected at 17 between the load links 14, and straps **19*a* and 19*b* are also extended from these connections 17, to define a loop 18,19 adapted to fit around the waist region or midsection of the carrying person A. The foot loops 16 will line up just below the waist loop 18,19** and on the opposite sides of the carrying person A.

A strap 20 is connected at 21 between the shoulder loops 12 and straps 22*a* and 22*b* are also extended from this connection 21 at the shoulder loops, to define a loop 20,22 adapted to fit around the upper body waist or chest region of the carried person C.

A strap 24*a* is connected at 23 off of strap 20 midway between the shoulder loops 12 and strap 24*b* is connected at 25 off of strap 22*b* approximately opposite thereto relative to the loop 20,22 effective to fit between the legs and under the seat of the carried person C.

Straps 26*a* and 26*b* are connected at 27 to the shoulder loops 12 adapted to fit across the upper body chest region of the carrying person A.

In one general mode of operation of the carrier 10, the shoulder loops 12 would fit over the arms and shoulders of a carrying person A, with the straps 18 and 20 being adjacent the back of the carrying person and with the link straps 14 depending along the carrying person's sides and symmetrically of the carrying person A. The carried person's feet are supported loosely in the foot loops 16, and the carried person C may stand adjacent the back of the carrying person A and face in the same direction. The carried person C can actively hang onto the carrying person as by gripping the shoulder loops 12 or the strap 20, and/or the carried person can be more passively and securely held in the carrier 10 by the strap loop 22 surrounding the waist or chest region of the carried person C.

In a preferred embodiment, padding 28 may be provided in the upper portions of the shoulder loops 12, for added comfort to the carrying person A, as the shoulder loops 12 will support most of the weight of the carried person C. The carrying person's midsection loop 18,19 may well support part of the weight of the carried person, but nonetheless it and strap 20 will hold the link straps 14 and foot loops 16 symmetrically to distribute such weight properly from the shoulders and back of the carrying person A.

Also in a preferred embodiment, a side release buckle 34 may be incorporated in the carrying person's waist loop 18,19, at the front straps 19*a* and 19*b* thereof, to allow the carrying person A to get into or out of the carrier 10 easily. For the same reason, a side release buckle 36 may be incorporated in the carrying person's chest loop 27, on straps 26*a* and 26*b*; a side release buckle 38 may be incorporated in the carried person upper body loop 20,22, on straps 22*a* and 22*b*; and a side release buckle 40 may be incorporated in the carried person's seat strap 24, on straps 24*a* and 24*b*.

Figure 3:
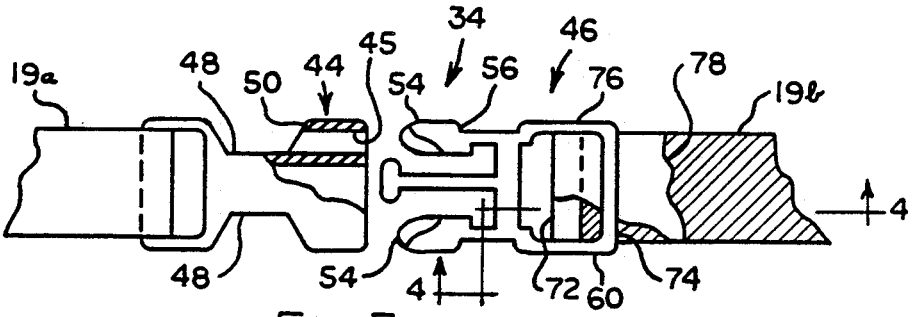
FIG. 3 is enlarged elevational views showing an opened side release device of the portable carrier.

Each side release buckle can be of conventional construction, buckle 34 being generally illustrated in an open condition in FIG. 3. The buckle 34 includes a tubular socket 44 connected to one strap 19*a* and an insert 46 connected to the other strap 19*b* and adapted to be inserted into and be locked within the socket 44. The socket 44 may have open ended guide slots, including side slot 45 terminating at inwardly facing shoulder 50 adjacent side relief opening 52. The insert 46 may have three projections or fingers, including side fingers 54 that fit in the opposed side slots 45 and having outwardly projected shoulders 56 thereon. When the insert 46 is fully inserted axially into the socket 44, the socket shoulders 50 of spring fingers shoulders 56 engage to preclude axial withdrawal of the insert 46 from the socket 44. However, the side fingers 54 being somewhat flexible and exposed via the side openings 48 can be pinched and laterally flexed together to release the shoulders and open the side release 34 to separate the straps 19*a* and 19*b*.

The side release buckle may be of the type disclosed in U.S. Pat. Nos. 4,150,484 and 4,171,555; and the specific teachings of these patents are incorporated herein by reference.

For adjusting the lengths of the various loops or straps, to adapt the carrier 10 to fit carrying and carried persons of different sizes, a preferred embodiment may further have friction slides incorporated therein. For example, slide 60 may be in the carrying person's midsection loop 19; slide 62 may be in the carrying person's chest loop 26; slides 66 may be in the carrying person's shoulder loops 12; slide 68 may be in the carried person's seat strap 24, and slide 70 may be in the carried person's upper body loop 22.

Figure 4:
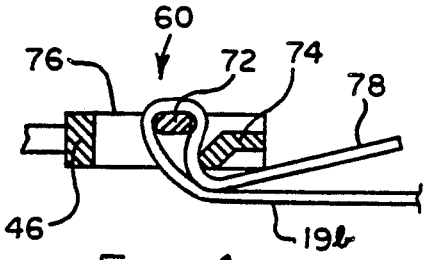
FIG. 4 is a fragmentary section, taken generally along line 4—4 in FIG. 3.

Each friction slide can be of conventional construction, being generally illustrated in FIG. 4, and may further where appropriate be formed on the end of a typical insert 46. Thus, laterally and axially separated cross members 72 and 74 are supported by side bars 76, to allow the end 78 of the strap 19*b* to be feed from under the slide up and over the upper remote cross member 72 and around and under then the underlying lower adjacent cross member 74, to be under the end portion 78 the strap 19*b*. The engaged faces of the cross members may have ridges (not shown) or the like formed thereon to add to the frictional resistance against the strap sliding thereon.

By having the strap 19*b* negotiate these sharp turns around the cross members 72 and 74 and under itself, tension applied on the strap 19*b* in the direction away from the slide may generate sufficient friction between the components to preclude the strap from sliding and changing its setting in the slide. By contrast, the free strap end 78 may be pulled in the direction away from the slide, overcoming tension of the strap 19*b*, to slide the loop strap into the slide to shorten the strap length.

Also, a conventional tri-glide 84 can be incorporated in the strap 19*a*, to allow suitable length adjustment of the strap 19*a* to center the side release buckle 34 on the carrying person when the proper tension is made on the waist loop 18,19 via the friction slide 60. This feature allows carrying persons of different sizes to use and be comfortable in the carrier 10.

During a typical preferred mode of use under normal adjustment, the foot loops 16 may be set vertically to have the carried person's head located above the shoulders of the carrying person and somewhat even with or slightly above the carrying person's head, when the carried person stands on the foot loops. Height adjustment of the foot loops is possible by varying the size of the shoulder loops 12 by friction slides 66. When the carried person C is supported in the carrier 10, the carried person's feet may be angled outwardly slightly and the inside of the carried person's legs below the knees may lie against the carrying person's back or sides.

With the carried person C standing in the foot loops 16, action akin to a horsey-back ride can be experienced by the carried person, including being very alert and actively flexing one's knees to compensate for vertical bouncing of the foot loops 16 as the carrying person walks or possibly even runs. However, the upper body strap 20,22 can surround the carried person to contain him/her rather securely within the carrier 10. When the seat strap 24 is also adjusted in place, the carried person can sit and be more passive, with possibly all of his/her weight carried by the seat strap 24 and upper body loop 20,22.

As the weight of the carried person C is properly distributed via the carrier straps to the shoulders, back and waist of the carrying person A, use of the carrier 10 greatly increases the endurance level and/or the load carrying capacity of the carrying person. The entire carrier 10 is lightweight and portable, but yet sufficiently strong and durable for extended use, by and for carrying and carried persons of varying sizes.

While only a single embodiment of the invention has been illustrated, it is apparent that variations may be made therefrom without departing from the inventive concept. Accordingly, the invention is to be limited only by the scope of the following claims.

What is claimed as our invention is:

1. A portable back carrier for carrying a person, comprising flexible generally nonextendable strap means formed to the combination of a pair of shoulder loops adapted to fit over the shoulders of the carrying person, a pair of load links respectively connected one each off of the shoulder loops, and a pair of foot loops respectively connected one each off of the load links; the strap means being proportioned to locate the load link connections off of the shoulder loops in the region generally underlying the carrying person's armpits and shoulders and the load links and foot loops depending therebelow and being along the sides of the carrying person, whereby a carried person can fit his/her feet into the foot loops and be supported thereby by standing adjacent the back of the carrying person while facing in the same direction as the carrying person, and the flexible shoulder loops generally assuming teardrop shapes around the shoulders to the load link connections; and strap means connected between the shoulder loops adjacent the back of the carrying person for providing upper body support of the carried person.

2. A portable back carrier according to claim 1, further including friction slide means in the shoulder loops, adjacent the chest of the carrying person, operable for adjusting the length of the shoulder loops and the teardrop shapes thereof and for thereby adjusting the height of the foot loops below the shoulders of the carrying person and adapting the back carrier for carried persons of different sizes.

3. A portable back carrier according to claim 1, further wherein said strap means connected between the shoulder loops for providing upper body support of the carried person includes a loop adapted to fit around the upper body of the carried person; and a strap connected off of the carried person's upper body loop at spaced front and rear locations thereof, to be loosely suspended therebetween, and each connection being approximately midway between the shoulder loops, to provide said strap is adapted to fit between the legs and under the seat of the carried person and support part of the weight thereof.

4. A portable back carrier according to claim 3, further including friction slide means for adjusting the lengths of the carried person's upper body loop and the carried person's seat strap, for adapting the carrier to fit carried persons of different sizes.

5. A portable back carrier according to claim 3, further including side release buckles incorporated in the carried person's upper body loop, to allow the carried person get into or out of the carrier easily.

6. A portable back carrier according to claim 3, further including side release buckles incorporated in the carried person's upper body loop, to allow the carried person get into or out of the carrier easily; and friction slide means for adjusting the lengths of the carried person's upper body loop and the carried person's seat strap, for adapting the carrier to fit carried persons of different sizes.

7. A portable back carrier according to claim 6, further including friction slide means in the shoulder loops, adjacent the chest of the carrying person, operable for adjusting the length of the shoulder loops and the teardrop shapes thereof and for thereby adjusting the height of the foot loops below the shoulders of the carrying person and adapting the back carrier for carried persons of different sizes.

8. A portable back carrier according to claim 1, further wherein said strap means connected between the shoulder loops for providing upper body support of the carried person includes a loop adapted to fit around the upper body of the carried person; a strap connected off of the carried person's upper body loop at spaced front and rear locations thereof, to be loosely suspended therebetween, and each connection being approximately midway between the shoulder loops, to provide said strap is adapted to fit between the legs and under the seat of the carried person and support part of the weight thereof; and friction slide means in the shoulder loops, adjacent the chest of the carrying person, operable for adjusting the length of the shoulder loops and the teardrop shapes thereof and for thereby adjusting the height of the foot loops below the shoulders of the carrying person and adapting the back carrier for carried persons of different sizes.

9. A portable back carrier according to claim 1, further including a strap means connected between of the load links, just above the foot loops, adapted to fit around the midsection of the carrying person, to locate the foot loops on the sides of and near the midsection of the carrying person; a side release buckle incorporated in the carrying person's midsection loop, at separate front portions thereof, to allow the carrying person get into or out of the carrier easily; and friction slide means in each separate front portions of carrying person's midsection loop, for adjusting the lengths of the carrying person's midsection loop for adapting the carrier to fit carrying persons of different sizes and to center the side release buckle on the carrying person when the proper tension is made on the carrying person's midsection loop.

10. A portable back carrier according to claim 9, further including friction slide means in the shoulder loops, adjacent the chest of the carrying person, operable for adjusting the length of the shoulder loops and the teardrop shapes thereof and for thereby adjusting the height of the foot loops below the shoulders of the carrying person and adapting the back carrier for carried persons of different sizes.

11. A portable back carrier according to claim 9, further wherein said strap means connected between the shoulder loops for providing upper body support of the carried person includes a loop adapted to fit around the upper body of the carried person; and a strap connected off of the carried person's upper body loop at spaced front and rear locations thereof, to be loosely suspended therebetween, and each connection being approximately midway between the shoulder loops, to provide said strap is adapted to fit between the legs and under the seat of the carried person and support part of the weight thereof.

12. A portable back carrier according to claim 11, further including friction slide means in the shoulder loops, adjacent the chest of the carrying person, operable for adjusting the length of the shoulder loops and the teardrop shapes thereof and for thereby adjusting the height of the foot loops below the shoulders of the carrying person and adapting the back carrier for carried persons of different sizes.

13. A portable back carrier according to claim 12, further including straps connected to the shoulder loops substantially opposite the carried person's upper body support loop, adapted to fit across the upper body chest region of the carrying person; and side release buckles and friction slide means incorporated in the said straps, to allow the carrying person get into or out of the carrier easily and for adapting the carrier to fit carrying persons of different sizes.

14. A portable back carrier according to claim 13, further including side release buckles incorporated in the carried person's upper body loop; and friction slide means for adjusting the lengths of the carried person's upper body loop and the carried person's seat strap, for adapting the carrier to fit carried persons of different sizes.

15. A portable back carrier for carrying a person, comprising flexible generally nonextendable strap means formed to the combination of a pair of shoulder loops adapted to fit over the shoulders of the carrying person, a pair of load links respectively connected one each off of the shoulder loops, and a pair of foot loops respectively connected one each off of the load links; the strap means being proportioned to locate the load link connections off of the shoulder loops in the region generally underlying the carrying person's armpits and shoulders and the load links and foot loops depending therebelow and being along the sides of the carrying person, whereby a carried person can fit his/her feet into the foot loops and be supported thereby by standing adjacent the back of the carrying person while facing in the same direction as the carrying person, and the flexible shoulder loops generally assuming teardrop shapes around the shoulders to the load link connections; friction slide means in the shoulder loops, adjacent the chest of the carrying person, operable for adjusting the length of the shoulder loops and the teardrop shapes thereof and for thereby adjusting the height of the foot loops below the shoulders of the carrying person and adapting the back carrier for carried persons of different sizes; first and second additional strap means, said first additional strap means being connected between the shoulder loops adjacent the back of the carrying person and defining a loop adapted to fit around the upper body of the carried person for providing upper body support of the carried person, and said second additional strap means being connected between the shoulder loops substantially opposite the first additional strap means and adapted to fit across the upper body chest region of the carrying person; and side release buckles and friction slide means incorporated in the said second additional strap means, to allow the carrying person get into or out of the carrier easily and for adapting the carrier to fit carrying persons of different sizes.

16. A portable back carrier according to claim 15, further including a seat strap connected off of the first additional strap means defining the carried person's upper body loop at spaced front and rear locations thereof, to be loosely suspended therebetween, and each connection being approximately midway between the shoulder loops, to provide said strap is adapted to fit between the legs and under the seat of the carried person and support part of the weight thereof.

17. A portable back carrier according to claim 16, further including third strap means connected between of the load links, just above the foot loops, adapted to fit around the midsection of the carrying person, to locate the foot loops on the sides of and near the midsection of the carrying person; a side release buckle incorporated in the carrying person's midsection loop, at separate front portions thereof, to allow the carrying person get into or out of the carrier easily; and friction slide means in each separate front portions of carrying person's midsection loop, for adjusting the lengths of the carrying person's midsection loop for adapting the carrier to fit carrying persons of different sizes and to center the side release buckle on the carrying person when the proper tension is made on the carrying person's midsection loop.

* * * * *